US005997009A

United States Patent [19]

Geise

[11] Patent Number: 5,997,009

[45] Date of Patent: Dec. 7, 1999

[54] SINGLE-PIECE SEAL MEMBER AND METHOD OF FORMING A SECONDARY SEAL

[75] Inventor: David Carl Geise, Cincinnati, Ohio

[73] Assignee: Formica Technology, Inc., Wilmington, Del.

[21] Appl. No.: 08/810,322

[22] Filed: Feb. 28, 1997

[51] Int. Cl.[6] ..... F16J 15/02; A47K 3/16

[52] U.S. Cl. ..... 277/650; 52/35; 277/944

[58] Field of Search ..... 277/650, 921, 277/648, 644, 627, 936, 944; 52/35

[56] References Cited

U.S. PATENT DOCUMENTS

| | | | |
|---|---|---|---|
| 3,455,080 | 7/1969 | Meadows | 52/476 |
| 3,667,179 | 6/1972 | Eisenberg | 52/209 |
| 3,803,760 | 4/1974 | Matvey | 52/102 X |
| 4,214,414 | 7/1980 | Wendt | 52/288.1 |
| 4,527,807 | 7/1985 | Urbanick | 277/642 |
| 4,570,948 | 2/1986 | Wunderlich et al. | 277/645 X |
| 4,691,392 | 9/1987 | Whitney | 52/35 X |
| 4,825,480 | 5/1989 | Moore | 52/35 X |
| 5,079,880 | 1/1992 | Reid | 52/35 |
| 5,213,339 | 5/1993 | Walworth | 277/625 X |
| 5,257,791 | 11/1993 | Cittadini et al. | 277/629 |
| 5,473,843 | 12/1995 | Laroche et al. | 52/35 |
| 5,566,954 | 10/1996 | Hahn | 277/642 |

*Primary Examiner*—Chuck Y. Mah
*Assistant Examiner*—Alison K. Pickard
*Attorney, Agent, or Firm*—Mayer, Brown & Platt

[57] ABSTRACT

The present invention relates to a single-piece seal member that has a substantially rigid portion and a substantially flexible portion. The substantially flexible portion extends from and is connected to the substantially rigid portion in a substantially seamless manner. The substantially flexible portion has a durometer reading less than that of the substantially rigid portion. The substantially rigid portion has a mounting configuration that can comprise an engaging mechanism. The engaging mechanism has a web element, and a first flange and a second flange extending from the web element. The first and second flanges are spaced apart from each other so as to engage a surface of a base structure such as along the deck of a bathtub or a shower base structure. A gripping arrangement is formed when at least one of the first and second flanges is angled relative to the other. In order to engage an angled edge of a base structure, the first and second flanges can have a mitered joint. Further, the present invention is directed to method of forming a secondary seal comprising the steps of fabricating a single-piece seal member, engaging the engaging mechanism onto an edge of a base structure, positioning the seal member against a wall frame, and fastening the substantially flexible portion of the seal member to the wall frame.

10 Claims, 3 Drawing Sheets

SINGLE-PIECE SEAL MEMBER AND METHOD OF FORMING A SECONDARY SEAL

BACKGROUND OF THE INVENTION

1. Field of The Invention

The present invention relates to a single-piece seal member for forming a secondary seal around a base structure, such as a shower, sink, bathtub or similar basin. Particularly, the present invention is directed to a single-piece seal having a substantially rigid portion and a substantially flexible portion, wherein the substantially rigid portion includes a mechanism to engage a surface of the base structure with the substantially flexible portion arranged in an upright manner.

Further, the present invention is directed to a method of forming a secondary seal around the base structure using the single-piece seal member.

2. Description of Related Art

Water containment is an important consideration during the construction and installation of sinks, bathtubs, shower stalls and similar basins. Bathtubs and shower stalls in particular are continually exposed to large amounts of water. Tubs and stalls require special consideration as to their design, construction, and installation so as to contain water and prevent water from leaking into the surrounding wall structure.

If water permeates beyond the tub or stall, the water will likely contact the surrounding wood framing and insulation. The wood framing and insulation typically are not exposed to enough air or air circulation to dry out once they become wet. Consequently, the water may cause rotting and other deterioration. Such deterioration leads to structural instability and foul odors. In sufficient quantities, water, following a path of least resistance, could leak into other areas of the dwelling.

Once the integrity of the wood framing and insulation are lost, it is difficult to replace or repair. Repair work could require the removal of surrounding tile, or the entire tub or shower unit if the tub or shower is a single-piece unit. This type of repair work is messy, costly, and time-consuming. For these reasons, tubs and showers are preferably constructed so that the surrounding wall framing and insulation remain dry.

Until relatively recently, shower stalls, bathtubs and sinks were fabricated from ceramic tile, cast iron covered with porcelain, or steel covered with porcelain. With the use of ceramic tile, a lead or rubber liner, called a "pan," was laid within an enclosure where the tub or shower was to be situated. The soft lead or rubber was folded up against the 2'×4' wall studs of the enclosure. With the pan material attached to the wall studs, concrete was poured with an opening left for a drain, and then the tile was laid in place. The pan was intended as a secondary seal to prevent water from leaking into the surrounding wall structure. With regard to cast iron or steel tub constructions, the primary seal against water was formed by applying caulking between the tub and the base of the surrounding tile. A cast raised bead or nailing flange is incorporated in many tubs to provide a secondary seal. Presently, a variety of plastics are a modern alternative to the tile and cast iron structures of the past. Surfacing materials include fiberglass, marble, fiber-reinforced plastic, and Surell® (a densified polyester resin-based material available from Formica Corp.). Plastics are more economically molded than steel or iron. In addition, plastics are lighter in weight, more flexible and more durable.

Some plastic tubs and shower bases are constructed so as to include an integral water seal. Particularly, the base structure of the tub or shower has an upstanding rigid flange along its perimeter. The rigid flange may be attached by a screw or nail to the wall studs. In turn, the wall panels that form the walls of the shower or tub are hung around the perimeter of the base structure of the tub or shower. Typically, the bottom edge of the wall panels are spaced a short distance from the tub or shower base unit. Caulking therefore is required to effectively seal the bottom edge of the wall panels. The caulking is the primary barrier to water and the upstanding rigid flange is the secondary barrier.

While effective at preventing water from leaking into the wall framing, tub and shower bases with integral water seals fixed in size. They cannot be used for custom or retrofit applications. Custom and retrofit applications require more flexible sizing where the base can be cut or trimmed to fit the desired enclosure.

Further, tub and shower base structures having an integral seal often require adjustment to fit into even standard size unfinished enclosures. In order to fasten the rigid flange to the wall studs, the integral seal tub or shower base structure must be pre-drilled and, sometimes, requires shims to adjust for variation in size and level. Pre-drilling and shims are needed to prevent the rigid flange from cracking or bending during installation.

The rigid flange likewise may crack or become crazed if improperly handled. For example, if an installer accidentally steps on the rigid flange, it could crack. Because rigid flanges are fragile, such tubs and shower bases require additional protection in packaging and handling.

In view of the above, there remains a need for a device and method of providing a secondary water seal in the event that the primary water seal between the surrounding wall panel and the base structure of the tub or shower fails. Further, there remains a need for a secondary seal that can be used with tub and shower base structures and allows for trimming or cutting at the installation site in order to fit into an enclosure. Additionally, the secondary seal must be attachable to the wall frame without cracking or bending and must be sturdy for handling and shipping purposes.

SUMMARY OF THE INVENTION

The purpose and advantages of the invention will be set forth in and apparent from the description and drawings that follow, as well as will be learned by practice of the invention. Additional advantages of the invention will be realized and attained by the elements of the apparatus and method particularly pointed out in the appended claims.

The seal member of the invention comprises a substantially rigid portion having a mounting configuration and a substantially flexible portion having a durometer value of less than that of the substantially rigid portion. The substantially flexible portion extends from and is connected to the substantially rigid portion in a substantially seamless manner. The substantially rigid portion and the substantially flexible portion can be extruded together to form a substantially seamless connection between them.

The mounting configuration of the substantially rigid portion has an engaging mechanism. The engaging mechanism has a web element; extending from the web element are a first flange and a second flange. The first and second flanges can be spaced from each other a predetermined distance so as to engage a surface of a base structure. To form a gripping arrangement, at least one of the first and second flanges is angled toward and relative to the other. The first and second flanges can have a mitered joint formed therein to permit engagement of the seal member onto an angled surface of a base structure.

Objectives of the seal member of the invention include, but are not limited to, providing a secondary water seal between a wall and the base structure of a basin to prevent water leakage therebetween, enabling custom fitting of the seal member, and facilitating easier assembly without specialized equipment or supplies. Advantages of the seal member of the invention include increased resistance to installation damage, ability to bend around curves and corners, effective fastening to wall frames that may be larger than recommended, and easier casting and molding of base structures resulting in less costly mold designs.

To achieve these and other advantages and in accordance with the purpose of the invention, as embodied and broadly described herein, the substantially rigid portion of the seal member can be made of a material selected from the group comprising polyvinyl chloride (PVC), acrylonitrile butadiene styrene plastic (ABS plastic), high density polyethylene (HDPE), low density polyethylene (LDPE), polypropylene, polystrene, nylon, or polycarbonate. Material for the substantially rigid portion is selected so that the substantially rigid portion has a flexual modulus value in the range of from about 320,000 to about 460,000 psi.

The substantially flexible portion of the seal member can be made of material selected from the group comprising polyvinyl chloride (PVC), polyurethane, thermoplastic rubber, thermoplastic elastomers, silicone, rubber compounds, high density polyethylene (HDPE), and low density polyethylene (LDPE). Material for the substantially flexible portion is selected so that the substantially flexible portion has a Shore A durometer value in the range of from about 45 to about 100.

Compatibility of the various materials identified for the substantially rigid and substantially flexible portions of the seal member so as to form a substantially seamless connection therebetween is known in the art.

The objects and advantages of the present invention are further achieved by a method of forming a secondary seal comprising the steps of fabricating a single-piece seal member as previously described, mounting the mounting configuration of the substantially rigid portion onto a surface of a base structure, positioning the seal member against a wall frame, and fastening the substantially flexible portion of the seal member to the wall frame. The method can further include the step of placing a primary wall panel proximate the wall frame so that the bottom of the primary wall panel is within a predetermined distance from the base structure. In addition, a secondary wall panel can be located between the wall frame and the primary wall panel.

The method of forming a secondary seal can further include the step of applying a sealing and adhesive compound proximate the mounting configuration of the seal member before mounting the seal member onto the surface of the base structure. In addition, a sealing and adhesive compound can be applied between the secondary wall panel and the primary wall panel and between the bottom of the primary wall panel and the base structure.

It is to be understood that both the foregoing general description and the following detailed description are exemplary and provided for purposes of explanation only, and are not restrictive of the invention, as claimed.

BRIEF DESCRIPTION OF THE DRAWINGS

The accompanying drawings, which are incorporated in and constitute a part of this specification, illustrate the preferred embodiment of the invention, and together with the description, serve to explain the principles of the invention.

DETAILED DESCRIPTION OF THE PREFERRED EMBODIMENT

Figure 1:
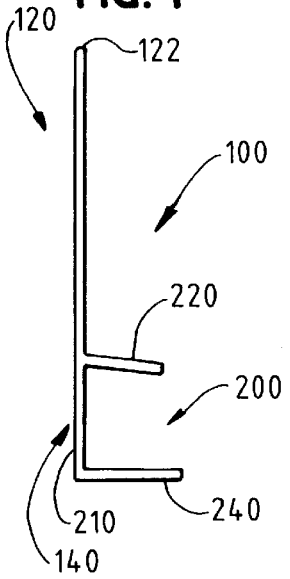
FIG. 1 is a profile view of a schematic representation of an embodiment of a single-piece seal member of the present invention.

Reference will now be made in detail to the present preferred embodiment of the single-piece seal member of the invention, examples of which are illustrated in the accompanying drawings. Wherever possible, the same reference characters will be used throughout the drawings to refer to the same or like parts. The method of the present invention will be described in conjunction with the detailed description of the single-piece seal member for clarity.

The single-piece seal member described and claimed herein, as well as the method of forming a secondary seal, may be embodied by a variety of different configurations and is not limited to the exemplary embodiments described in the detailed description of the invention.

A side view of an exemplary embodiment of the single-piece seal member of the present invention is shown in FIG. 1 and designated generally by reference character 100. FIG. 1 shows a single-piece seal member comprising a substantially rigid portion 140 having a mounting configuration and a substantially flexible portion 120. The substantially flexible portion 120 has a durometer value of less than that of the substantially rigid portion 140. The substantially flexible portion 120 extends from and is connected to the substantially rigid portion 140 in a substantially seamless manner.

The substantially rigid portion 140 can be made of a variety of materials including, but not limited to, polyvinyl chloride (hereinafter "PVC"), acrylonitrile butadiene styrene plastic (ABS plastic), high density polyethylene (HDPE), low density polyethylene (LDPE), polypropylene, polystrene, nylon, or polycarbonate. In a preferred embodiment, the substantially rigid portion 140 is made of PVC.

The rigidity of the substantially rigid portion 140 is measured by the flexual modulus of the material. The flexual modulus of the substantially rigid portion 140 of the invention is in the range of from about 320,000 to about 460,000 pounds per square inch ("psi"). Several forms of rigid PVC have flexual moduli in this range.

The substantially flexible portion 120 of the invention can be made of a variety of materials including, but not limited to, PVC, polyurethane, thermoplastic rubber, thermoplastic elastomers, silicone, rubber compounds, high density polyethylene (HDPE), and low density polyethylene (LDPE). The flexibility of the substantially flexible portion 120 can be measured by the Shore A durometer value of the material. A Shore A durometer value is a measure of the stiffness of a material; the lower the value, the softer and more flexible the material. The Shore A durometer value of the substantially flexible portion 120 is in the range of from about 45 to about 100. In a preferred embodiment the invention has a Shore A durometer value in the range of from about 80 to about 100. In another preferred embodiment of the invention the substantially flexible portion 120 has a Shore A durometer value of about 90.

The substantially rigid portion 140 and the substantially flexible portion 120 are connected in a substantially seamless manner. In a preferred embodiment, the material used to form the substantially rigid portion 140 is simultaneously or co-extruded with the material used to form the substantially flexible portion 120 to form the single-piece seal member 100. Dual-extrusion provides a substantially seamless connection between the two portions. Using dual-extrusion to provide the substantially seamless connection allows different materials to be used for the substantially rigid portion 140 and the substantially flexible portion 120. Conventional dual or single extrusion equipment for plastics can be used to form the seal member 100 of the invention. Extrusion technology and compatibility of the various materials for purposes of forming a substantially seamless connection are known in the art.

Additional substantially seamless connections include, but are not limited to, an extrusion of a single material with a variation from a rigid to a flexible characteristic. If the single material selected is typically rigid, it can be modified to be selectively less rigid so that post-extrusion characteristics fulfill the dual purpose of forming both the substantially rigid portion 140 and the substantially flexible portion 120.

For purpose of example, but not limitation, the use of PVC having a Shore A durometer value of 90 for the substantially flexible portion 120 and the use of PVC having a flexual modulus in the range of 320,000 to 460,000 psi for the substantially rigid portion 140 is preferred.

The substantially rigid portion 140 has a mounting configuration to attach the single-piece seal member 100 to the base structure for which a water seal is needed. Being of substantially rigid construction, the mounting configuration is relatively stiff in order to provide a fixed point of attachment to an object such as a surface of a bathtub or shower base structure. The mounting configuration is selected based on the type of object to which the seal member 100 is to be attached.

For example, the mounting configuration of the substantially rigid portion 140 may comprise a flush surface that may be fixed to a surface of the base structure using a sealant or the like. In another embodiment of the invention, and as shown herein, the mounting configuration has an engaging mechanism 200. The engaging mechanism 200 is shaped and sized to fit the shape of the base structure to which the mounting configuration of the seal member 100 is to be attached. Consequently, the engaging mechanism 200 can have, but is not limited to, a straight, curved or scrolled contour.

In a preferred embodiment, the engaging mechanism 200 has a web element 210, a first flange 220 and a second flange 240. The first flange 220 and second flange 240 are spaced from each other and extend from the web element 210. With respect to the embodiment depicted in FIG. 1, the engaging mechanism 200 formed by the web element 210, first flange 220, and second flange 240 is configured to mount the seal member 100 against a planar surface of a base structure. The contour of the engaging mechanism 200 can be varied by changing the shape of the web element and flanges, if any.

The substantially flexible portion 120 of the seal member 100 embodied in FIG. 1 generally is an upstanding element extending from the substantially rigid portion 140. If desired, the substantially flexible portion 120 may include a tapered distal end 122 for a smooth transition against which a wall panel may be attached.

Figure 2:
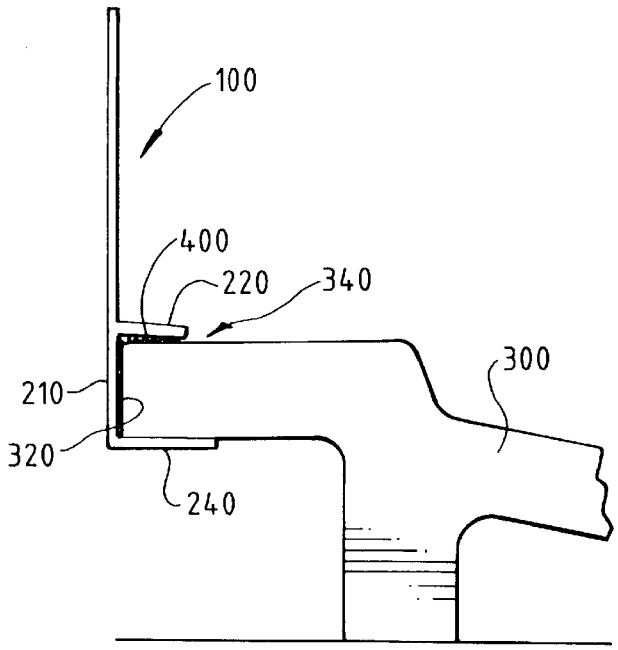
FIG. 2 is a sectional side view of the single-piece seal member shown in FIG. 1 mounted on a surface of a shower base structure.

Further in accordance with the present invention, FIG. 2 shows the single-piece seal member 100 mounted on a surface of a shower base structure 300. In a preferred embodiment of the invention, the first flange 220 and the second flange 240 are spaced from each other a predetermined distance so as to engage a surface 320 of a base structure 300. The base structure 300 can be, but is not limited to, a bathtub or a floor base for a shower stall.

While the seal member 100 of the invention can be designed for use with a variety of bathtub and shower styles, the seal member is very effective with surfacing materials, such as fiberglass, marble, cultured marble, and Surell® (densified polyester solid surfacing material). Solid surface material, such as Surell®, is commonly used as a base structure 300 for a bathtub or shower and typically has an edge surface 320 around its perimeter. The seal member 100 can be manufactured with a variable space between the first flange 220 and the second flange 240 so that surfaces 320 of varying widths can be engaged.

In another preferred embodiment of the engaging mechanism 200, at least one of the first flange 220 and second flange 240 is angled relative to the other so as to form a gripping arrangement. This gripping arrangement allows the seal member 100 to be mounted on the surface 320 to secure the attachment of the mounting of the base structure 300 more readily. By angling one flange relative to the other, a squeezing or gripping action can be established.

In FIG. 2, the first flange 220 is angled relative to the second flange 240. Thus, the mounting configuration generally remains attached against the edge surface 320 because the contour of the engaging mechanism 200 substantially matches the width and contour of the edge surface 320 with flanges 220, 240 biased to squeeze or grip a portion 340 of the base structure 300 as shown. Additional gripping arrangements, besides relative angling of the flanges, can include modifying the surface of the engaging mechanism 200 and modifying the shape of the flanges 220, 240.

Figure 4:
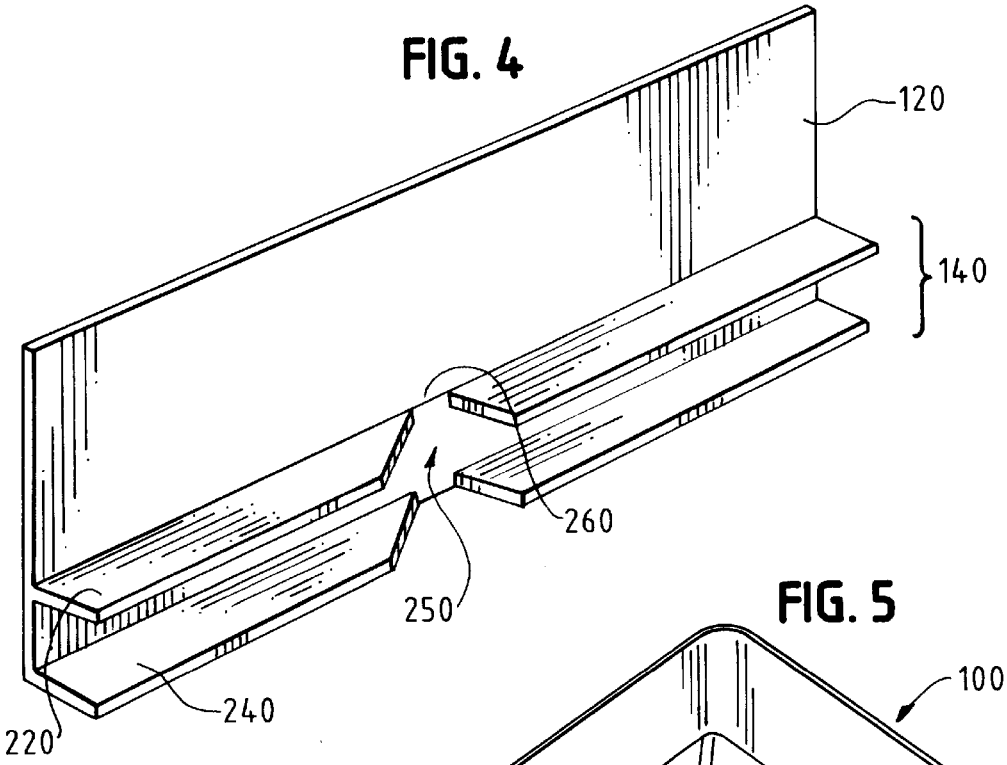
FIG. 4 is an orthogonal view of a single-piece seal member of the invention mitered to form a miter joint.

The seal member 100 of the present invention also may be adapted to provide an effective seal at a curved or angled edge of the base structure 300. As such, and as embodied herein, the first flange 220 and the second flange 240 each may have a mitered joint 250 formed therein. The mitered joint 250 of the first flange 220 and the second flange 240 is depicted in FIG. 4. The mitered joint 250 permits engagement of an angled edge of a base structure 300. Although stiff and intended to provide a fixed attachment, the mitered joint 250 allows the substantially rigid portion 140 to bend around a curved or angled edge of the base structure 300. Particularly, a gap area 260 between the mitered sections of the miter joint 250 covers the corners of the base structure 300 to prevent crazing or cracking of the substantially rigid portion 140. The substantially flexible portion 120 does not require a joint to wrap around the curved or angled edge of the base structure 300 as it has sufficient flexibility to bend around the curve without cracking.

Figure 5:
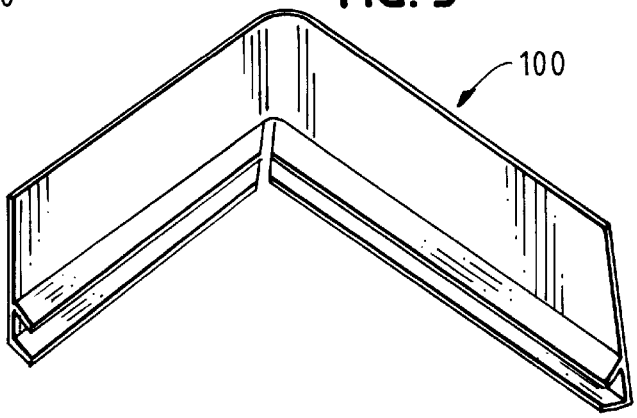
FIG. 5 is an orthogonal view of the single-piece seal member with a miter joint as arranged to engage a corner of a base structure shown in FIG. 4.

FIG. 5 depicts the seal member 100 of FIG. 4 as it would appear wrapped around a corner of a base structure 300. The seal member 100, having a mitered joint 250, maintains integrity and effectiveness for sealing against water even in the angled or curved edges of the base structure 300.

Figure 7:
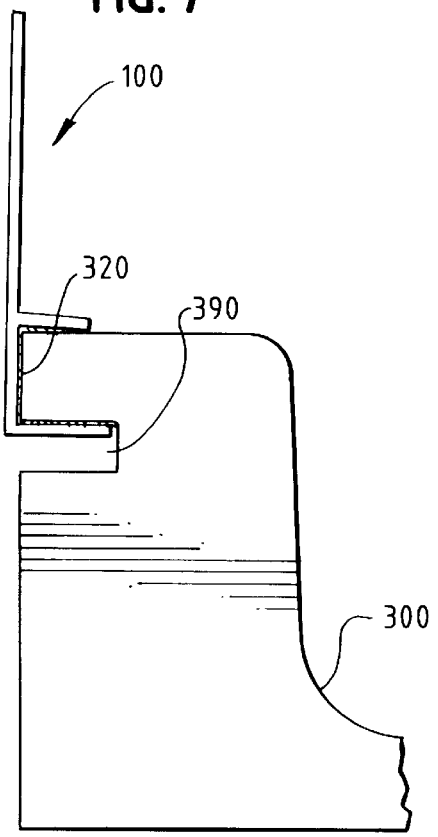
FIG. 7 is a sectional side view of an embodiment of the invention mounted to an existing Surell® shower base.

The single-piece seal member 100 of the invention is an effective secondary or back-up water seal, in the event the primary seal fails, for many types of base structures 300. An example of a solid surface base structure 300 to which the seal member 100 can be applied is a Surell® walled shower base not having an integral secondary water seal, as depicted in FIG. 7. The walled shower base 300 depicted in FIG. 7 has a slot 390 at the base of the surface 320. The slot 390 allows the seal member 100 to be snapped onto the surface 320 of the base structure 300 easily and securely.

Figure 8:
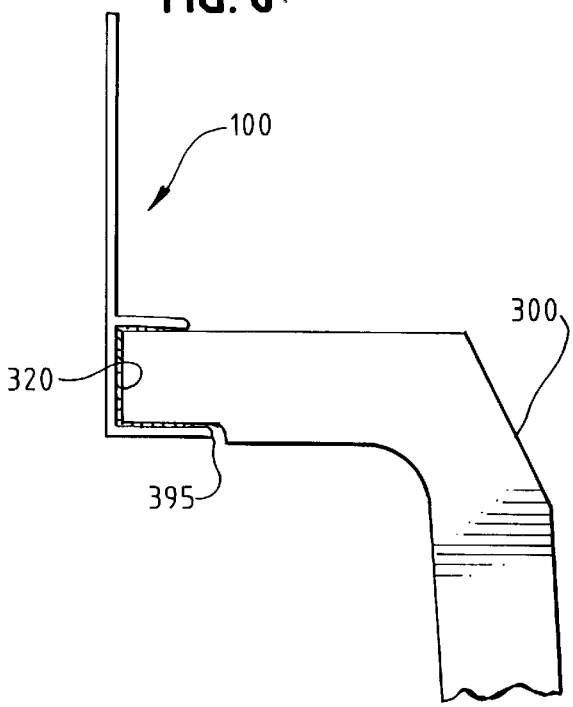
FIG. 8 is a sectional side view of an embodiment of the invention mounted on a surface of a Surell® bathtub base structure.

Another example of an appropriate solid surface base structure 300 is depicted in FIG. 8. FIG. 8 shows the edge surface 320 of a deck of a Surell® bathtub with a seal member 100 mounted thereon. Although not required, the tub deck 320 has a thin groove 395 milled into it in order to receive the seal member 100. Preferably, the depth of the groove 395 is in the range of from about ⅝ to about ¾ of an inch.

Figure 9:
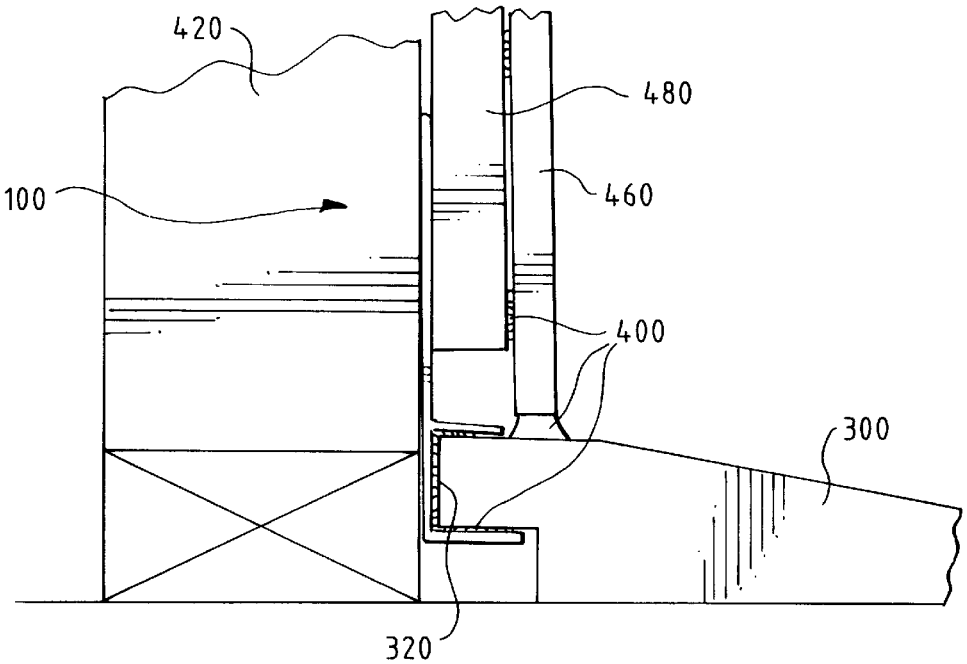
FIG. 9 is a sectional side view of an embodiment of the invention mounted on a surface of a slab shower base.

FIG. 9 depicts use of the seal member 100 to provide a secondary water seal with an example of a shop fabricated plastic shower base structure 300. In another embodiment, not depicted in the figures, the seal member 100 can provide an effective water seal for slab-style shower bases which may not otherwise have a back-up water seal. The fabricated base structure 300 may be fabricated from a variety of materials which may include solid surfacing materials such as Surell®, cultured marble or fiber-reinforced plastic. The seal member 100 is mounted on the edge surface 320 of the fabricated base structure 300.

Figure 3:
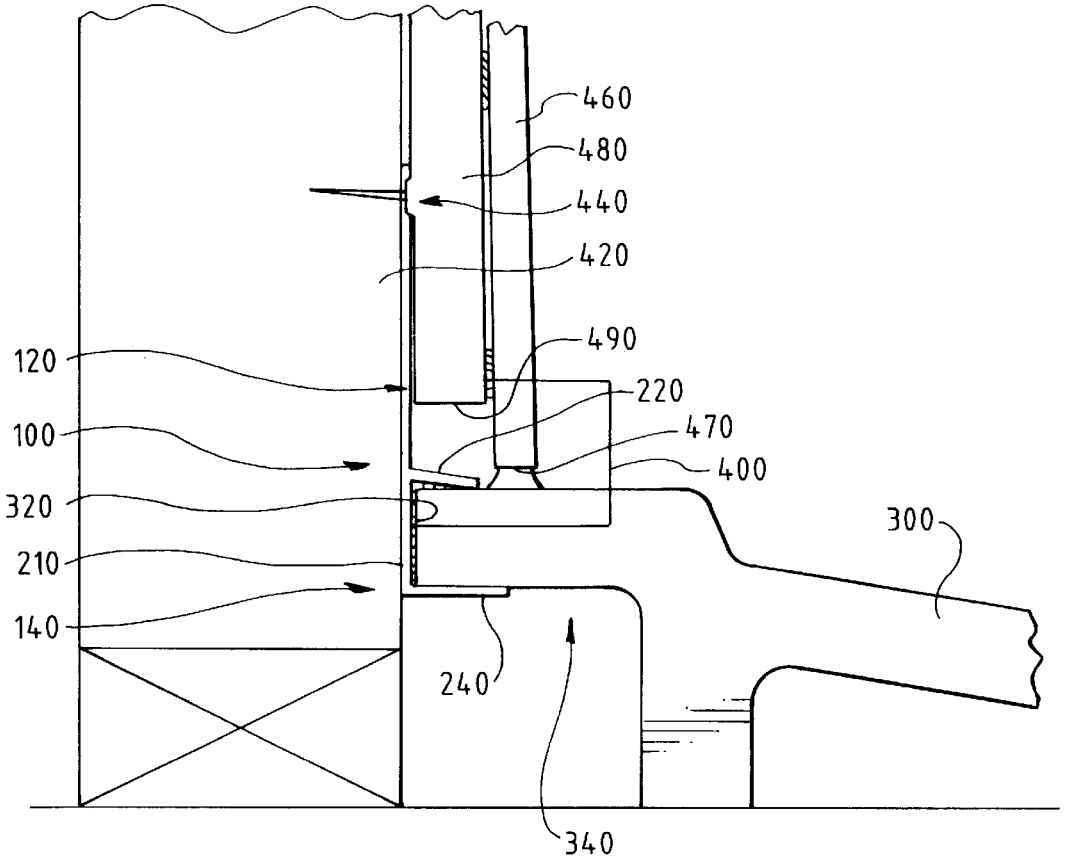
FIG. 3 is a sectional side view of a single-piece seal member of the invention as installed to form a secondary seal.

The present invention also includes a method of forming a secondary seal between the base structure and a wall frame. With reference to FIG. 3, the method of forming a secondary seal comprises the steps of providing a single-piece seal member 100, as previously described, mounting the mounting configuration of the seal member 100 onto a surface 320 of the base structure 300, positioning the substantially flexible portion 120 of the seal member 100 against the wall frame 420, and fastening the substantially flexible portion 120 of the seal member 100 to the wall frame 420.

FIG. 3 depicts a sectional side view of the seal member 100 attached to a base structure 300 and fastened to a wall frame 420 as the combination would appear after completion of all of the steps of the preferred method. After mounting the engaging mechanism 200 onto an edge surface 320 of the base structure 300, as previously described, the seal member 100 is positioned against a wall frame 420. The substantially flexible portion 120 is fastened to the wall frame 420 with a fastener 440. The substantially flexible portion 120 of the invention accepts a fastener 440, such as a nail, tack, adhesive or screw, without cracking and without requiring pre-drilling.

A benefit of the method of the invention is that the substantially flexible portion 120 easily bends for fastening to the wall frame 420. This benefit is realized when the size of the enclosure for the bathtub or shower is somewhat different than expected. For example, rigid shower base flanges or shower bases with integral seals of the prior art would require shims and pre-drilling to fit into enclosures slightly larger than expected.

Figure 6:
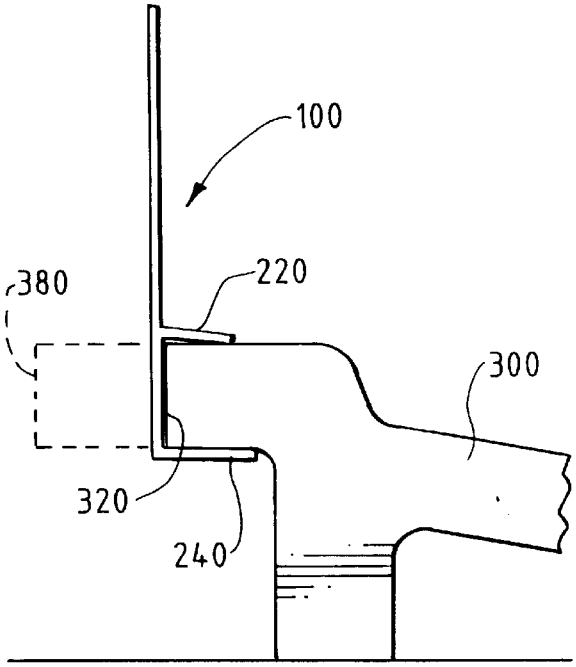
FIG. 6 is a sectional side view of a single-piece seal member of the invention mounted on a surface of a base structure that has been trimmed.

The method of the invention also works especially well with custom sized bathtubs or showers. The method of forming a secondary water seal allows for trimming and cutting of the base structure 300 prior to attachment of the seal member 100. Shower bases with integral side walls or integral water seals of the prior art cannot be altered or customized during installation. By contrast, FIG. 6 shows a sectional side view of a seal member 100 of the invention attached to an edge surface 320 of a base structure 300 that has been altered. Dashed lines show the trimmed portion 380 of the edge 320 that was removed during installation to custom fit the base structure 300 into the available enclosure.

Preferably, the method further comprises the step of placing a primary wall panel 460 proximate the wall frame 420 of the primary wall panel is within at least about ¼ inch of the base structure 300. Generally, the primary wall panel 460 is made of a water resistant or nonabsorptive material, such as marble, granite, plastics or ceramics. The primary wall panel 460 may be a single sheet, a plurality of sheets or even an array of tiles.

In order to form a primary water seal, the bottom edge 470 of the primary wall panel 460 and the base structure 300 must be close enough to be sealed with a sealing compound 400 as described further below. The secondary seal formed by the method of invention therefore is intended to act as a back-up if the primary water seal fails.

In addition, the preferred method also includes the step of locating a secondary wall panel 480 between the wall frame 420 and the primary wall panel 460. The secondary wall panel 480 is generally gypsum, cement board or a similar substrate. Because such materials may be water absorptive, the bottom edge 490 of the secondary wall panel 480 preferably is further from the base structure 300 than the bottom edge 470 of the primary wall panel 460. This allows water accumulation along the seal member 100 with reduced risk of saturation of the secondary wall panel 480 through direct contact or capillary action. Locating the secondary wall panel 480 this way makes installation easier and permits the substantially flexible portion 120 to be curved behind the secondary wall panel 480.

In another embodiment of the method of the invention, a sealing compound 400 is applied to provide adhesion and to form the primary water seal. The sealing compound 400 can be selected from a group comprising, but not limited to, silicone, urethane, and butyl-rubber. Preferably, the sealing and adhesive compound 400 is silicone because of its low cost, high performance and widespread availability. For example, the method further comprises the step of applying a sealing and adhesive compound 400 between the engaging mechanism 200 and the base structure 300. Particularly, and as shown in FIGS. 2 and 3, the sealing and adhesive compound 400 is applied between the web 210 and the surface 320, as well as between at least one of the flanges 220, 240 and an adjacent surface of the base structure 300. Application of the sealing and adhesive compound 400 along the web 210 and either the first flange 220 or the second flange 240 of the engaging mechanism 200 can be performed prior to engaging the engaging mechanism 200 onto the surface 320 of the base structure 300 to increase the stability of the attachment of the seal member 100 to the edge 320 and to enhance the water sealing function. Particularly, the sealing compound may be applied directly onto the seal member 100 or onto the base structure 300.

Sealing compound is applied between the bottom edge 470 of the primary wall panel 460 and the edge 320 of the base structure 300 to form the primary wall seal as noted above. Sealing and adhesive compound 400 can also be applied between the secondary wall panel 480 and the primary wall panel 460 to improve water resistance and to cause adhesion between the two wall panels. Application of a sealing and adhesive compound 400 is depicted in FIGS. 3 and 9.

Attachment of the seal member 100 of the invention to an edge 320 of a base structure 300 for a bathtub or shower for purposes of forming a secondary seal exhibits additional improvements over prior art bathtub and shower bases. The substantially flexible portion 120 of the seal member 100 eliminates the need for a rigid flange. The rigid flange of prior art bathtub and shower base structures is fragile and requires special packaging and handling. If the integral rigid flange of the prior art is accidentally stepped on or dropped during installation, it is subject to crazing and cracking. The substantially flexible portion 120 bends without damage if stepped on during installation. In addition, rigid flanges require more complex molds for fabrication.

In view of the description above, it is evident that the present invention for a single-piece seal member and method of forming a secondary water seal provides several advantages over the prior art including eliminating the need for a rigid flange, permitting custom fitting of bathtub and shower base structures during installation and prior to attachment of the seal member, resisting damage, and flexible fastening of the seal member to the frame of off-sized enclosures.

Although reference has been made to the use of the present invention for the formation of a secondary water seal in the installation of bathtubs and shower stalls for the purpose of explanation, it is understood that alternative uses of the seal member and method of forming a secondary seal of the invention may exist. It also will be apparent to those skilled in the art that various modifications and variations can be made in the design and construction of the single-piece seal member, as well as in the performance of the method, without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A single-piece seal member for forming a secondary seal around a base structure comprising:

a substantially rigid portion having a mounting configuration for attachment to a base structure, the mounting configuration comprising at least a first flange member extending therefrom; and a substantially flexible portion having a durometer value less than that of the substantially rigid portion, the substantially flexible portion extending away from the mounting configuration and the substantially rigid portion, wherein the substantially flexible portion is substantially perpendicular to the first flange member for allowing said substantially flexible portion to be mounted against a flat surface; and wherein said substantially flexible portion is connected to the substantially rigid portion in a substantially seamless manner.

2. The seal member of claim 1 wherein the mounting configuration of the substantially rigid portion has an enganging mechanism.

3. The seal member of claim 2 wherein the engaging mechanism has a web element, extending from the web element is at least a first flange.

4. The seal member of claim 3 further including a second flange, the first flange being spaced from the second flange by a predetermined distance so as to engage a surface of the base structure.

5. The seal member of claim 4 wherein at least one of the first and second flanges is angled relative to the other of the first and second flanges so as to form a gripping arrangement.

6. The seal member of claim 3 wherein the first flange has a mitered joint formed therein to permit engagement of an angled edge of base structure.

7. The seal member of claim 1 wherein the substantially rigid portion is made of a material selected from the group consisting of polyvinyl chloride (PVC), acrylonitrile butadiene styrene plastic (ABS plastic), high density polyethylene (HDPE), low density polyethylene (LDPE), polypropylene, polystrene, nylon, or polycarbonate.

8. The seal member of claim 1 wherein the substantially flexible portion is made of material selected from the group consisting of polyvinyl chloride (PVC), polyurethane, thermoplastic rubber, thermoplastic elastomers, silicone, rubber compounds, high density polyethylene (HDPE), and low density polyethylene (LDPE).

9. The seal member of claim 1 wherein the substantially flexible portion has a Shore A durometer value in the range of from about 45 to about 100.

10. The seal member of claim 1 wherein the substantially rigid portion has a flexual modulus value in the range of from about 320,000 to about 460,000 psi.

* * * * *